US008525449B2

(12) United States Patent
Torikai et al.

(10) Patent No.: US 8,525,449 B2
(45) Date of Patent: Sep. 3, 2013

(54) CHARGED PARTICLE BEAM EXTRACTION METHOD USING PULSE VOLTAGE

(75) Inventors: Kota Torikai, Maebashi (JP); Satoru Yamada, Maebashi (JP)

(73) Assignee: Nat'l University Corporation Gunma University, Maebashi-shi (JP)

( * ) Notice: Subject to any disclaimer, the term of this patent is extended or adjusted under 35 U.S.C. 154(b) by 0 days.

(21) Appl. No.: 13/390,002

(22) PCT Filed: Aug. 10, 2010

(86) PCT No.: PCT/JP2010/063566

§ 371 (c)(1),
(2), (4) Date: Apr. 24, 2012

(87) PCT Pub. No.: WO2011/019036

PCT Pub. Date: Feb. 17, 2011

(65) Prior Publication Data

US 2012/0200237 A1 Aug. 9, 2012

(30) Foreign Application Priority Data

Aug. 11, 2009 (JP) ..... 2009-186622

(51) Int. Cl.
*H05H 13/04* (2006.01)

(52) U.S. Cl.
USPC ..... 315/503; 315/504; 315/505; 315/506; 315/507

(58) Field of Classification Search
USPC ..... 315/500–507
See application file for complete search history.

(56) References Cited

U.S. PATENT DOCUMENTS 5,285,166 A 2/1994 Hiramoto et al.
5,363,008 A 11/1994 Hiramoto et al.
7,439,528 B2 * 10/2008 Nishiuchi et al. ..... 250/492.3

(Continued)

FOREIGN PATENT DOCUMENTS

EP 1976348 A1 10/2008
JP 5-109499 A 4/1993

(Continued)

OTHER PUBLICATIONS

K. Endo et al Development of high filed dipole and high current pulse power power supply for compact proton synchrotron, Proceedings of the 2003 Particle Accelerator Conference.*

(Continued)

*Primary Examiner* — Daniel Cavallari
*Assistant Examiner* — Srinivas Sathiraju
(74) *Attorney, Agent, or Firm* — Westerman, Hattori, Daniels & Adrian, LLP

(57) ABSTRACT

A charged particle beam extraction method according to the present invention is featured in that, in a circular accelerator which accelerates a charged particle beam, a pulse voltage is applied to a part of the accelerated charged particle beam to generate a momentum deviation only in the part of the charged particle beam, in that the charged particles of a part of the charged particle beam, the charged particles having a large momentum deviation, are located in a non-stable region and in an extraction region in a horizontal phase space with respect to the traveling direction of the charged particle beam, and in that a group of the charged particles located in the non-stable region and in the extraction region are largely deviated in the horizontal direction so as to be extracted.

9 Claims, 10 Drawing Sheets

(56) References Cited

U.S. PATENT DOCUMENTS

| | | | | |
|---|---|---|---|---|
| 8,084,965 | B2 * | 12/2011 | Takayama et al. | 315/503 |
| 8,217,596 | B1 * | 7/2012 | Douglas et al. | 315/503 |
| 2009/0195194 | A1 | 8/2009 | Takayama et al. | |
| 2011/0284760 | A1 * | 11/2011 | Balakin | 250/396 R |

FOREIGN PATENT DOCUMENTS

| | | | |
|---|---|---|---|
| JP | 5-198397 | A | 8/1993 |
| JP | 9-035899 | A | 2/1997 |
| JP | 2006-310013 | A | 11/2006 |
| JP | 2007-018756 | A | 1/2007 |
| JP | 2007-018757 | A | 1/2007 |
| JP | 2007-018849 | A | 1/2007 |
| JP | 2007-165220 | A | 6/2007 |
| JP | 2008-071494 | A | 3/2008 |

OTHER PUBLICATIONS

International Search Report of PCT/JP2010/063566, mailing date Sep. 7, 2010.

* cited by examiner (A) When Extraction is not performed

Phase Space Distribution in Travelling Dorection

Phase Space Distribution in Horizontal Dorection (B) When Extraction is performed According to the Present Invention Phase Space Distribution in Travelling Dorection Phase Space Distribution in Horizontal Dorection

CHARGED PARTICLE BEAM EXTRACTION METHOD USING PULSE VOLTAGE

TECHNICAL FIELD

The present invention relates to an accelerator mainly configured by a circular accelerator referred to as a synchrotron, and more particularly, to a technique of extracting an accelerated charged particle beam.

BACKGROUND ART

Conventionally, a synchrotron using a high-frequency voltage generated from a high-frequency accelerating cavity has been used to accelerate a charged particle beam. In recent years, a method for accelerating a charged particle beam by using an induced voltage generated by an induction accelerating cell has been developed. The accelerated charged particle beam has been used for a physical experiment, a medical treatment, and the like.

In the synchrotron, a charged particle beam is circulated along a design orbit while undergoing betatron oscillation. Conventionally, in order to extract an accelerated charged particle beam, "third resonance", which is a resonance phenomenon occurring in the horizontal direction (referred to as the lateral direction, the radial direction, the x direction, or the like) of the charged particle beam, has been used as described in the prior art of Patent Literature 1.

Here, the "horizontal direction" of a charged particle beam means the direction in which the direction of increasing the radius of the circulation surface of the orbit of the charged particle beam in the synchrotron is defined as the positive direction. When the charged particle beam circulates in the synchrotron, and when the circulating orbit of the charged particle beam is observed from above the circulation surface, the centrifugal force acts on the positive side in the horizontal direction. For this reason, an extracting port of the charged particle beam is generally arranged on the outer side of the circulating orbit so as to prevent the circulating beam line and the extraction beam line from interfering with each other. At the time of extracting a charged particle beam, a part of the charged particles circulating on the outermost side, among the circulating charged particles, are extracted.

Conventionally, in order to extract a charged particle beam from its circulating orbit by using the third resonance, there has been used one of the following methods: (1) changing the energy of the charged particle beam in its traveling direction; (2) making the charged particle beam oscillate at a resonance frequency by using a lateral high-frequency electric field; and (3) changing the stable region of betatron oscillation by exciting a six pole magnet.

Here, the magnetic field generated by the six pole magnet defines the size of the stable region in the horizontal phase space of the charged particle beam. As the intensity of the magnetic field is increased, the size of the stable region is reduced. Further, the phase space can be represented as a plane in which the relative position of each charged particle with respect to the center of the design orbit drawn by a reference particle is adopted as the abscissa, and in which the momentum deviation of each charged particle is adopted as the ordinate. The phase space is generally used to explain the behavior of a charged particle beam It is known that the condition that a charged particle beam can be retained in the stable region is influenced both by the coordinates of each charged particle in the horizontal phase space and by the momentum deviation of each charged particle in its traveling direction. That is, it is known that, even among charged particles located at the same coordinates in the phase space, when the momentum deviation of a charged particle in its traveling direction is large, the stable region of the particle in the phase space is small.

For example, an invention corresponding to the charged particle beam extraction method (3) is disclosed in Patent Literature 1. The invention described in Patent Literature 1 is featured in that the emittance is increased before the start of extraction of a charged particle beam (claim 1). Further, the invention described in Patent Literature 1 is featured in that the emittance in the horizontal or perpendicular direction at the start of extraction of a charged particle beam is substantially fixed without depending on the energy of the beam (claim 2). Further, the invention described in Patent Literature 1 is featured in that the emittance in the horizontal or perpendicular direction is substantially fixed during a period from the time of start of acceleration or from the middle of acceleration to the end of acceleration (claim 3). The principle of the invention described in Patent Literature 1 is shown in FIG. 8. Here, the emittance means a "phase space spread" of a charged particle beam resulting from the momentum error of each of actual charged particles with respect to the motion trajectory of an ideal charged particle.

FIG. 8 is a schematic view which shows the principle of a conventional charged particle beam extraction method of extracting a charged particle beam by changing the energy of the charged particle beam and in which the ordinate represents the momentum deviation ($\Delta p/p$) in the charged particle beam and the abscissa represents the time (t).

The momentum deviation ($\Delta p/p$) in the charged particle beam means a ratio of a deviation ($\Delta p$) between the traveling direction momentum of a charged particle (reference particle) having the energy to circulate along the design orbit and the traveling direction momentum of each of charged particles, with respect to the traveling direction momentum (p) of the reference particle. Reference character $T_0$ denotes a time period (circulation period) required for the reference particle to circulate along the design orbit once in the synchrotron.

As shown in FIG. 8, in the conventional charged particle beam extraction method, a high-frequency voltage 6*e* (solid line) is applied, from a high-frequency generation apparatus provided separately from a high-frequency accelerating cavity, to an entire charged particle beam 6 (dotted line) accelerated by a high-frequency voltage 2*c* (dotted line) generated from the high frequency accelerating cavity, so that an entire charged particle group 6*a* (solid line) is further accelerated (in the direction shown by the upward arrow) just before the charged particle beam is extracted. Thereby, a charged particle group 6*b* (colored portion) deviated from the stable region to a non-stable region 8*a* is selectively extracted to an emission line 4, for example, by an emission deflector.

In any of the conventional charged particle beam extraction method, including the technique described in Patent Literature 1, the accelerated charged particle beam as a whole is influenced as shown in FIG. 8. Further, much time is required for adjusting the charged particle beam to the extraction state. Further, the intensity of the extracted charged particle beam is greatly varied, so that it is difficult to fix the beam intensity.

In the conventional charged particle beam extraction method, the beam intensity [A] of the extracted charged particle beam cannot be fixed due to the following reasons.

The conventional synchrotron using a high-frequency voltage (RF) is based on the premise that the high-frequency voltage performs both the function of confining the charged particle beam in its traveling direction and the function of accelerating the charged particle beam. Further, as for the horizontal resonance frequency, even when a state of fixed magnetic field intensity is to be created by the magnetic field intensity of a deflecting electromagnet and by the magnetic field intensity of a converging electromagnet, the magnetic field intensity is changed in a range of the order of $10^{-4}$ (represented by the double arrow between the solid line and the dotted line in the stable region 8*a* in FIG. 8) under the influence of power supply noise, and the like.

Further, the extraction condition of a charged particle beam is based on the condition that the energy error (momentum deviation) of the charged particles in the charged particle beam is a fixed value or more, that is, on the condition that the charged particle beam circulates away from the design orbit in the horizontal direction, and is also based on the condition that a decimal part of the resonance frequency defined by the magnetic field intensity reaches one third.

Therefore, as the conventional charged particle beam extraction method, one of the following methods are used: (1) a method in which the magnetic field intensity of the six pole magnet is changed in the state where the energy of the charged particle beam is fixed, that is, the charged particle beam is not accelerated, (2) a method in which the charged particle beam is accelerated in the state where the magnetic field intensity of the six pole magnet is fixed, and (3) a method in which the charged particle beam is further horizontally oscillated at a horizontal resonance frequency in the state where the magnetic field intensity of the six pole magnet and the energy of the charged particle beam are fixed.

However, in the above-described extraction methods (1) and (2), since a charged particle beam always exists in a state where the "resonance condition" is barely satisfied, and since the horizontal betatron frequency is also changed according to the change of the magnetic field due to noise, the moment when the condition that the decimal part of the resonance frequency determined by the intensity of the magnetic field reaches one third is satisfied, and the moment when the condition is not satisfied, are determined by noise. Since the noise is not a controllable factor, only a beam intensity having a large temporal variation is obtained by the above-described methods (1) and (2).

On the other hand, in the above-described method (3), the intensity of the charged particle beam can be made constant to some extent, but much time is required to increase the oscillation of the charged particle beam after a high-frequency voltage is applied to change the horizontal resonance frequency of the charged particle beam (Patent Literature 1).

As shown in FIG. 8, in the conventional charged particle beam extraction method, since the entire charged particle beam is accelerated by a low high-frequency voltage different from the high-frequency voltage used in the high-frequency accelerating cavity, a part of the charged particle beam is always in contact with the region of the resonance condition (non-stable region 8*a*), and the resonance condition are also varied as described above. Further, a large number of times of circulations of the charged particle beam are required to return the charged particle beam from the region of the resonance condition (non-stable region 8*a*) to the design orbit.

In this way, in the conventional charged particle beam extraction method which is based on the variation of the resonance condition and in which the charged particle beam is extracted due to noise, the extraction condition, that is, the beam intensity of the extracted charged particle beam cannot be controlled to be temporally fixed.

FIG. 9 shows the distribution of charged particles in the phase space in a conventional circular accelerator. On the abscissa x which represents the horizontal direction, and in which the coordinate 0 corresponds to the position of the design orbit, the positive direction side from the coordinate 0 is the outer side of the design orbit, and the negative direction side from the coordinate 0 is the inner side of the design orbit. The ordinate x' represents the orbit gradient x'=dx/ds corresponding to the horizontal momentum, in which dx represents a lateral position of an actual charged particle beam when the design orbit is used as the origin, and in which ds represents the position of the actual charged particle beam in its traveling direction.

The group of charged particles forming the charged particle beam circulates while undergoing betatron oscillation. In the case where the stable state, in which the charged particle beam continuously circulates in the synchrotron, is continued, when the orbits of the charged particles are plotted in the stable state, each of the charged particles draws an orbit (closed orbit) closed in the phase space.

Here, in the state where no external force is applied to the charged particle beam circulating in the synchrotron, the size of the charged particle beam is increased in the X and Y directions due to the repulsive force between the electric charges of ions. For this reason, beam converging force is generated by a four pole electromagnet so that the charged particle beam can stably circulate in a vacuum duct.

At this time, the charged particle beam circulates in the synchrotron while performing an oscillation motion which is based on the relationship between the repulsive force and the converging force and which is described by the same equation as the spring motion. Because of the same principle as the principle that a resonance frequency exists in a mechanical structure, the charged particle beam also has a resonance frequency at which, when an oscillation having a specific frequency is given to the charged particle beam, the amplitude of the oscillation is increased with time.

The lateral oscillation frequency during one circulation of the charged particle beam is referred to as tune, and it is known that the resonance condition of the beam is established when the decimal part of the tune is ½ or ⅓ . . . 1/n.

Each of the charged particles forming the charged particle beam has a momentum and a position which are slightly different from those of the other charged particles. When the amplitude of the resonance is adjusted, the timing relationship in the circulating direction of the charged particle beam is not influenced by the adjustment, but the lateral amplitude of only the charged particle satisfying the resonance condition is increased, so that the charged particle reaches the extraction orbit. The resonance amplitude of the charged particle beam is adjusted by establishing the above-described resonance condition by adjusting the current of the four pole electromagnet or the six pole magnet.

At this time, when the charged particle beam is extracted by using the third resonance, since the oscillation frequency of the charged particle beam is different depending on the position and momentum of the charged particle beam, the region (stable region) in which the charged particle beam can be stably circulated, and the region (non-stable region) in which the amplitude of the resonance is increased, are respectively separated into inner and outer regions of a triangle as shown in FIG. 9. The region inside the triangle is the stable region, and the region outside the triangle is the non-stable region. When the charged particle beam is circulated in the state where the decimal part of the tune is slightly larger than ⅓ or ⅔, and when the energy of the charged particle beam is increased while the magnetic field given to the charged particle beam is kept constant, the tune is reduced, and hence the non-stable region in the figure is reduced.

Therefore, in the state where the resonance state is close to the third resonance state, the charged particle beam is moved to return to substantially the same coordinates in the phase space after being circulated three times in the synchrotron, and hence the stable region is made to have a shape close to a triangular shape. Each of the charged particles forming the charged particle beam has a different Δp/p.

The betatron oscillation frequency is determined by the intensity of the magnetic field generated by the deflecting electromagnet and the converging electromagnet which configure the synchrotron, and the size of the stable region is determined by the intensity of the magnetic field generated by the six pole magnet. That is, whether or not a charged particle draws a closed orbit is determined by whether or not the value of Δp/p of the charged particle is a certain value or less, which is determined by the six pole magnet. When the value of Δp/p and the intensity of the magnetic field generated by the six pole magnet are respectively assumed to be certain values, the boundary of the stable region corresponds to the boundary of the triangle shown in FIG. 9.

Note that, since each of the charged particles has a different value of Δp/p, the size of the stable region is reduced when the value of Δp/p is increased, and the size of stable region of a charged particle having a value of Δp/p larger than a certain threshold value is reduced to zero. That is, even in the case where the intensity of the magnetic field generated by the six pole magnet is fixed, when the value of Δp/p of a charged particle becomes larger than a certain value, the charged particle is surely extracted. In other words, the size of the stable region is different depending on the value of Δp/p of each of the charged particles.

In FIG. 9, the inside of a (large) triangle surrounded by boundaries 8*d* shown by dotted lines is a stable region 8*b* of charged particles 6*d* (black dots) under acceleration. When the entire charged particle beam is accelerated with the high-frequency voltage 6*e* to extract the charged particle beam, the momentum of a charged particle 6*c* is increased, and the stable region is changed to a stable region 8*c* (Δp/p=0.003) shown by the hatched region surrounded by a boundary 8*f*. The size of the stable region 8*c* is reduced as the value of Δp/p is increased. Here, the sake of convenience, the momentum deviation of the charged particle before acceleration is assumed as Δp/p=0.0026, and the momentum deviation of the charged particle after acceleration is assumed as Δp/p=0.003.

As described above, the charged particle 6*d* having a small value of Δp/p draws a closed orbit in the stable region 8*b* and hence is not extracted. On the other hand, the lateral oscillation of the charged particle 6*d* located in the non-stable region 8*a* is gradually increased as shown by the broken-dotted line, and hence the orbit of the charged particle 6*d* is expanded toward the outer side. At a certain part located on the synchrotron orbit, an emission deflector is provided, which generates an electric field only in the region located at a certain position in the lateral direction and which largely deflects the orbit of the charged particle entering the region.

Note that the region (extraction region 8*e*), in which the electric field is generated, is determined at the time of designing the emission deflector. The charged particle 6*d* located in the non-stable region 8*a* enters the extraction region 8*e*, so as to be extracted into the emission line 4. On the other hand, the charged particle 6*c* in the stable field 8*c* continues to be circulated in the synchrotron. When the value of Δp/p of the charged particle 6*c* is further increased by the high-frequency voltage 6*e*, the charged particle 6*c* is extracted.

An accelerator using a high-frequency accelerating cavity for realizing the charged particle beam extraction method described in Patent Literature 1 is shown in FIG. 10 in which a part of the names, reference numerals and characters, and the like, are changed from those described in Patent Literature 1.

As shown in FIG. 10, a conventional accelerator 1*a* is configured by an injection line 3, a synchrotron 2*n*, the emission line 4, and a beam utility line 5.

The injection line 3 is configured by a preceding accelerator 3*a* by which charged particles generated by an ion source are accelerated so as to have a predetermined speed, an injector 3*b* which injects the charged particles into the synchrotron 2*n* via a transport pipe 3*c*, and the like.

The synchrotron 2*n* is a circular accelerator which accelerates the injected charged particle beam 6 and which emits the accelerated charged particle beam to the emission line 4 by using the third resonance. The synchrotron 2*n* is configured by deflection electromagnets 2*i* which maintain the orbit of the charged particle beam 6 on a design orbit 2*a* inside a vacuum duct, converging electromagnets 2*j* or divergent electromagnets 2*k* which are quadrupole electromagnets generating converging force or divergent force, a high-frequency accelerating cavity 2*b* in which the charged particle beam 6 is confined and accelerated by the high-frequency voltage 2*c*, a high-frequency voltage application apparatus 2*m* which applies the high-frequency voltage 6*e* for accelerating the charged particle beam 6 at the time of extracting the charged particle beam 6, and which is different from the high-frequency accelerating cavity 2*b*, a six pole magnet 8 which is a multipole electromagnet for resonance excitation, and the like. The charged particle beam 6 is circulated along the design orbit 2*a* while undergoing betatron oscillation.

The emission line 4 is configured by an emitter 4*a*, such as an emission deflector, a transport pipe 4*b*, and the like. The beam utility line 5 is installed at a laboratory or a medical treatment site. The coordinate system is set so that the circulating direction of the charged particle beam 6 is the s axis, the horizontal direction is the x axis (the outer side is set to be positive and the inner side is set to be negative), and the perpendicular direction is the y axis.

On the other hand, in each of Patent Literatures 2 to 6, a technique is disclosed as a charged particle acceleration method using an induction accelerating cell. The technique disclosed in Patent Literature 2 is to provide an accelerating method in which all kinds of ions can be confined and accelerated by using induced voltages which are applied to a charged particle beam from two kinds of induction accelerating cells for confinement and acceleration. Further, the technique is featured in that the preceding accelerator can be eliminated when the extraction energy given to the charged particle beam by the ion source is equal to or larger than the minimum energy required for the circulation of the charged particle beam in the synchrotron.

Patent Literatures 3 to 6 respectively provide a method for controlling the generation timing of the induced voltage applied from the induction accelerating cell, a method for controlling the circulating orbit of the charged particle beam by controlling the generation timing of the induced voltage, and a method for controlling the synchrotron oscillation frequency by applying the induced voltage to the charged particle beam.

Patent Literature 6 provides a method for accelerating the charged particle beam by controlling the generation timing of an induced voltage including positive and negative induced voltages which are applied by a pair of induction acceleration apparatuses and which have a same rectangular shape.

However, a method for extracting the accelerated charged particle beam by using an induced voltage (pulse voltage) generated from the induction accelerating cell is not discussed in Patent Literature 6.

Here, in particle beam therapy, the irradiation dose of a charged particle beam is an amount proportional to the time integration of the particle beam current. The irradiation field of the charged particle beam is a three-dimensional space region to be subjected to radiation irradiation. When the required irradiation dose is irradiated inaccurately or non-uniformly in the target irradiation field, or when the irradiation dose is too much, the probability of occurrence of a serious side effect is increased. On the other hand, when the irradiation dose is insufficient, the probability of recurrence of a tumor in the irradiated part is increased.

That is, in particle beam therapy, it is required to accurately and uniformly perform irradiation of an intended irradiation dose without excess or insufficiency. Therefore, in order to perform irradiation of a high irradiation dose in a short time period, it is very important that the charged particle beam intensity can be temporally controlled.

The charged particle beam extracted from the synchrotron has a diameter of several centimeters. Therefore, in a particle beam therapy apparatus in which a large irradiation area is required, the charged particle beam is irradiated onto a target after the irradiation area of the charged particle beam is expanded in such a manner that the charged particle beam is deflected by using a rotating magnetic field generated by a so-called wobbler electromagnet installed at the extraction beam line 5.

This method is referred to as a wobbler irradiation method. Since the rotation frequency of the rotating magnetic field is 100 Hz or less, when a charged particle beam extraction method, in which the extracted charged beam intensity is not temporally stable, is adopted, the irradiation dose in the irradiation field of therapeutic irradiation needs to be made uniform by irradiating the charged particle beam repeatedly many times while changing the starting point of the rotating magnetic field. Therefore, in the charged particle beam irradiation therapy, the treatment time is increased mainly due to the beam intensity being temporally unstable, which imposes a very large burden on a patient.

Further, as another charged particle beam irradiation method, a method referred to as a spot scanning irradiation method is adopted, in which a required irradiation dose is supplied to a required irradiation part by scanning the charged particle beam on a two dimensional surface similarly to the electron beam scanning in the cathode-ray tube television.

When the irradiation dose is locally changed by the spot scanning irradiation method, the local irradiation dose is determined by the charged particle beam itself. For this reason, when the beam intensity is not temporally stable, the irradiation dose is adjusted by reducing the average beam intensity and by performing the irradiation for a long time. As a result, the burden on a patient is further increased.

Generally, in particle beam therapy, a patient is fixed to a treatment table by using a fixing device having high rigidity in order to improve the irradiation position accuracy. For a medical treatment of a patient whose general conditions are often not good, the increase in the treatment time not only causes a great pain but also becomes a problem which even determines whether or not the irradiation treatment can be applied to the patient.

CITATION LIST

Patent Literature

Patent Literature 1: Japanese Patent Laid-Open No. 09-35899

Patent Literature 2: Japanese Patent Laid-Open No. 2006-310013

Patent Literature 3: Japanese Patent Laid-Open No. 2007-018756

Patent Literature 4: Japanese Patent Laid-Open No. 2007-018849

Patent Literature 5: Japanese Patent Laid-Open No. 2007-018757

Patent Literature 6: Japanese Patent Laid-Open No. 2007-165220

SUMMARY OF INVENTION

Technical Problem

To cope with the above-described problems, an object of the present invention is to provide a charged particle beam extraction method in which a charged particle beam is stably extracted at high speed by using a pulse voltage, and further the intensity of the extracted charged particle beam is made uniform so as to enable the irradiation dose to be highly precisely controlled.

Solution to Problem

In order to solve the above described problems, the present invention is configured to provide a charged particle beam extraction method used in a circular accelerator which accelerates a charged particle beam, the method being featured in that a momentum deviation is generated only in a part of the accelerated charged particle beam by applying a pulse voltage to a part of the charged particle beam, in that a part of the charged particles, the part having a large momentum deviation, is located in a non-stable region and in an extraction region in a horizontal phase space with respect to the traveling direction of the charged particle beam, and in that a group of the charged particles located in the non-stable region and in the extraction region is extracted by being selectively and largely deviated in the horizontal direction.

Further, the charged particle beam extraction method according to the present invention is featured by including feedback control in which a beam monitor is provided in an extraction line of the charged particle beam, and in which the number of times of application of the pulse voltage to the charged particle beam is determined on the basis of a beam intensity signal from the beam monitor. Further, the present invention is configured to provide one of the above-described charged particle beam extraction methods, which is featured in that the pulse voltage is a positive or negative voltage in the traveling direction of the charged particle beam. Further, the present invention is configured to provide one of the above-described charged particle beam extraction methods, which is featured in that the beam intensity of the charged particle beam to be extracted is adjusted by adjusting the voltage value or the application time period of the pulse voltage.

Further, the present invention is configured to provide an accelerator including an injection apparatus of charged particles, a synchrotron which accelerates the charged particles by a high-frequency accelerating cavity, an emission apparatus of the charged particles, and a charged particle beam utility line, the accelerator being featured by further including, on a design orbit of a circulating charged particle beam, a pulse voltage generation apparatus which applies a pulse voltage to a part of the charged particle beam, and featured in that a momentum deviation is generated only in a part of the accelerated charged particle beam by applying the pulse voltage to a part of the charged particle beam, in that the charged particles of a part of the charged particle beam, the charged particles having a large momentum deviation, are located in a non-stable region and in an extraction region in a horizontal phase space with respect to the traveling direction of the charged particle beam, and in that a group of the charged particles located in the non-stable region and in the extraction region are extracted into the charged particle beam utility line by using an emission apparatus which selectively and largely deflects the group of the charged particles in the horizontal direction.

Further, the present invention is configured to provide the above-described accelerator featured by further including feedback control means in which a beam monitor is provided in an extraction line for extracting the charged particle beam to the charged particle utility line, and which, on the basis of a beam intensity signal of the beam monitor, determines the number of times of application of the pulse voltage to the charged particle beam. Further, the present invention is configured to provide one of the above-described accelerators featured in that the pulse voltage generation apparatus applies the pulse voltage from the induction accelerating cell to a part of the charged particle beam on the basis of a passage signal from a bunch monitor which is provided on the design orbit and which detects the passage of the charged particle beam, and on the basis of a position signal from a position monitor which is provided on the design orbit and which detects the center-of-gravity position of the charged particle beam.

Advantageous Effects of Invention

The present invention exhibits the following effects by the configurations described above. First, by applying the pulse voltage to a part of the charged particle beam, it is possible to perform control of the charged particle beam such that only a part of the charged particle beam is accelerated so as to be stably extracted at high speed. Thereby, the extraction time period can be reduced to about one tenth of the extraction time period of the conventional charged particle beam extraction method. Therefore, when the present invention is adopted to be used in a medical accelerator, the irradiation time period can be significantly reduced, so that the burden on a patient can be remarkably reduced.

Further, a control method, in which the intensity of the extracted beam is monitored and in which the monitored beam intensity is fed back to the pattern of the pulse voltage, is adopted, and thereby the intensity of the extracted charged particle beam can be made uniform. Therefore, when the present invention is adopted to be used in a medical accelerator, the control of the intensity and irradiation dose of the charged particle beam can be performed highly precisely and instantaneously with respect to an irradiation portion. Thereby, since an irradiation dose required for a treatment can be correctly irradiated, an intended treatment effect can be surely obtained, and at the same time, the exhibition of unexpected and unnecessary side effects can be remarkably suppressed.

DESCRIPTION OF EMBODIMENTS

In the following, a charged particle beam extraction method according to the present invention will be described.

Figure 1:
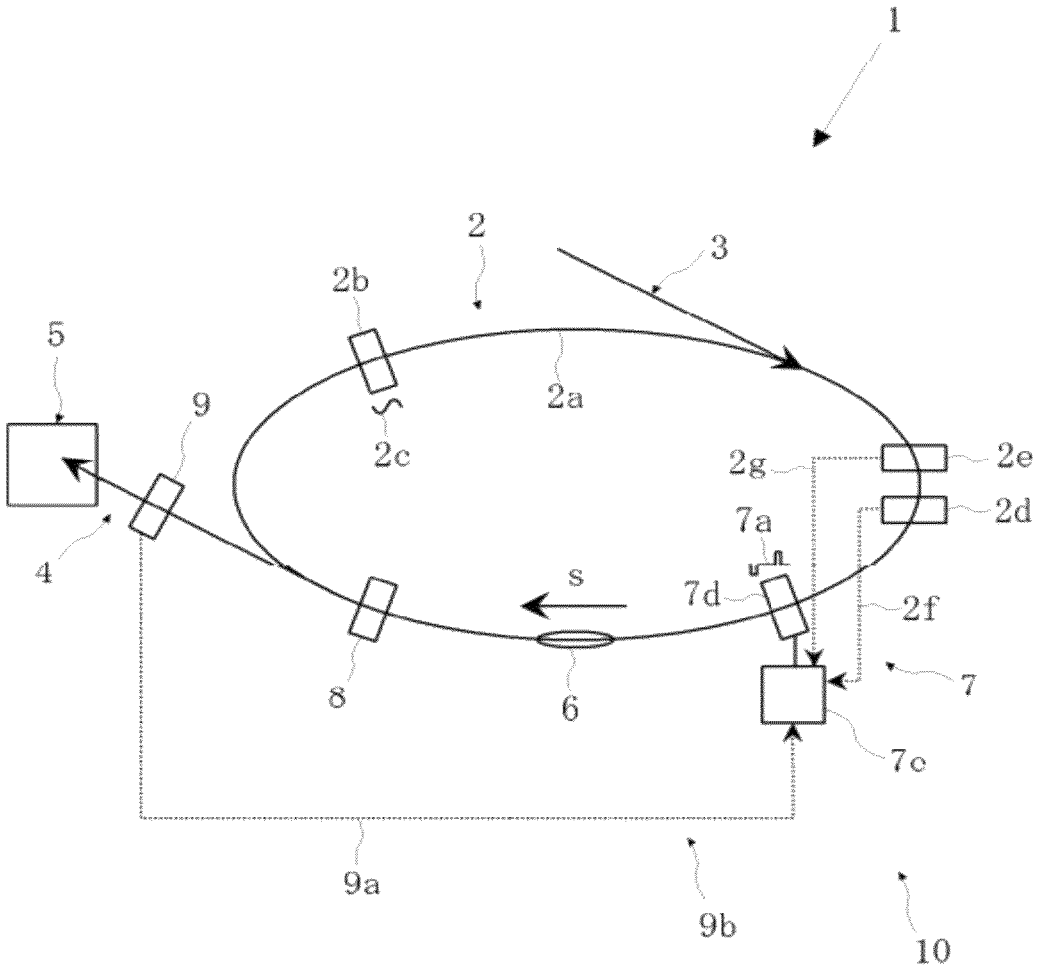
FIG. 1 is a schematic view of an accelerator according to the present invention.

FIG. 1 is a schematic view of an accelerator according to the present invention.

An accelerator 1 used for a method for extracting a charged particle beam 6, according to the present invention, is configured by an injection line 3, a synchrotron 2, and an emission line 4, a beam utility line 5, and a beam extraction control mechanism 10 which controls extraction of the charged particle beam 6.

Figure 10:
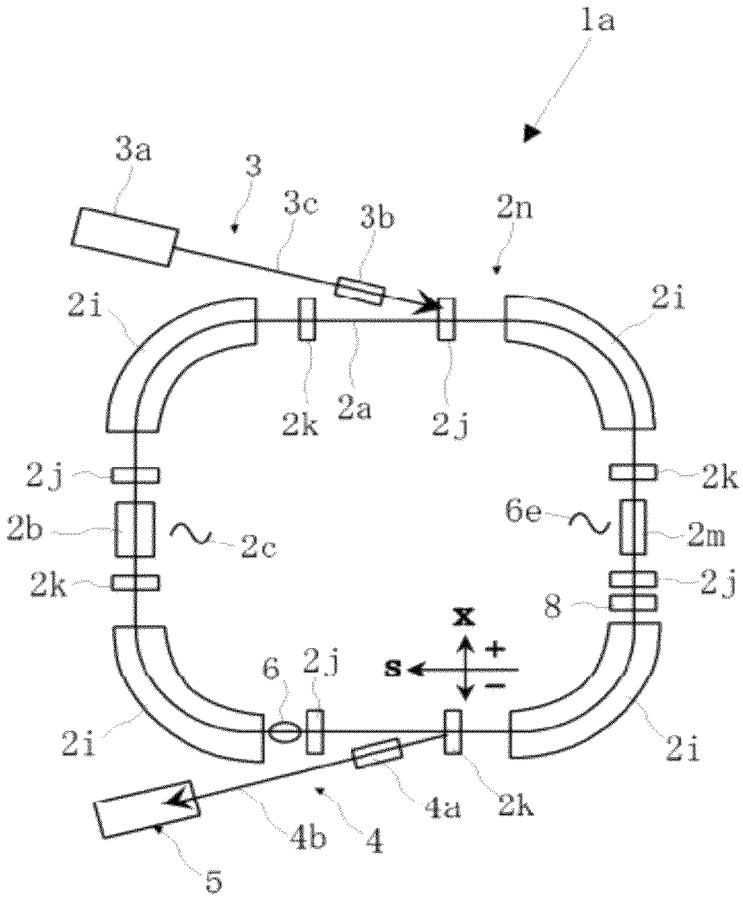
FIG. 10 is a schematic view of the conventional circular accelerator.

Conventional techniques can be used for the injection apparatus 3, the synchrotron 2, the emission apparatus 4, and the beam utility line 5. The portions denoted by the same reference numerals and characters as those in FIG. 10 have the same operations and functions, and the explanation of the portions is omitted. The beam extraction control mechanism 10 is configured by a pulse voltage generation apparatus 7 and a beam monitor 9. Note that the high-frequency voltage application apparatus 2*m* in FIG. 10 is replaced by the pulse voltage generation apparatus 7 in the synchrotron 2.

Figure 2:
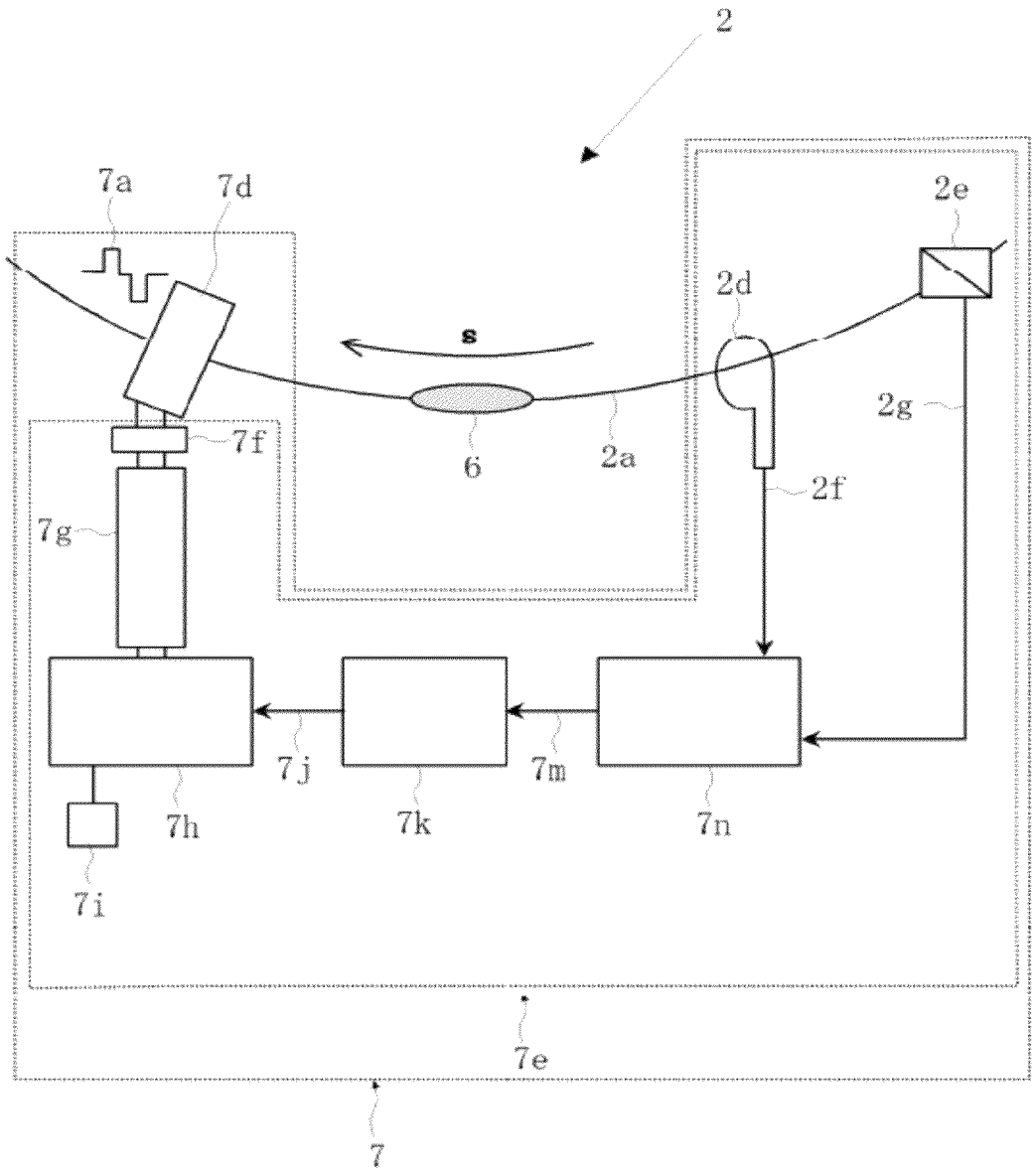
FIG. 2 is a schematic view of an example of a pulse voltage generator.

As the pulse voltage generation apparatus 7, any apparatus, which generates a pulse voltage 7*a*, may be used as long as the pulse voltage 7*a* can accelerate and decelerate the charged particle beam 6. Further, the shape of the pulse voltage is not also limited to a rectangular shape. FIG. 2 shows a method for controlling the generation of the pulse voltage 7*a*, and an example of a configuration of the pulse voltage generation apparatus 7.

An example of a configuration of the pulse voltage generation apparatus 7, which applies the pulse voltage 7*a* as an induced voltage to a part of the charged particle beam 6 in synchronization with the acceleration of the charged particle beam 6, will be described with reference to FIG. 2.

The pulse voltage generation apparatus 7 is configured by an induction accelerating cell 7*d* which generates the pulse voltage 7*a* as an induced voltage, and a control apparatus 7*e* which controls the generation of the pulse voltage 7*a*. The pulse voltage generation apparatus 7, the basic configuration of which is the same as that described in Patent Literature 6, may be configured such that it can apply the pulse voltage 7*a* as an induced voltage to a part of the charged particle beam 6.

Figure 3:
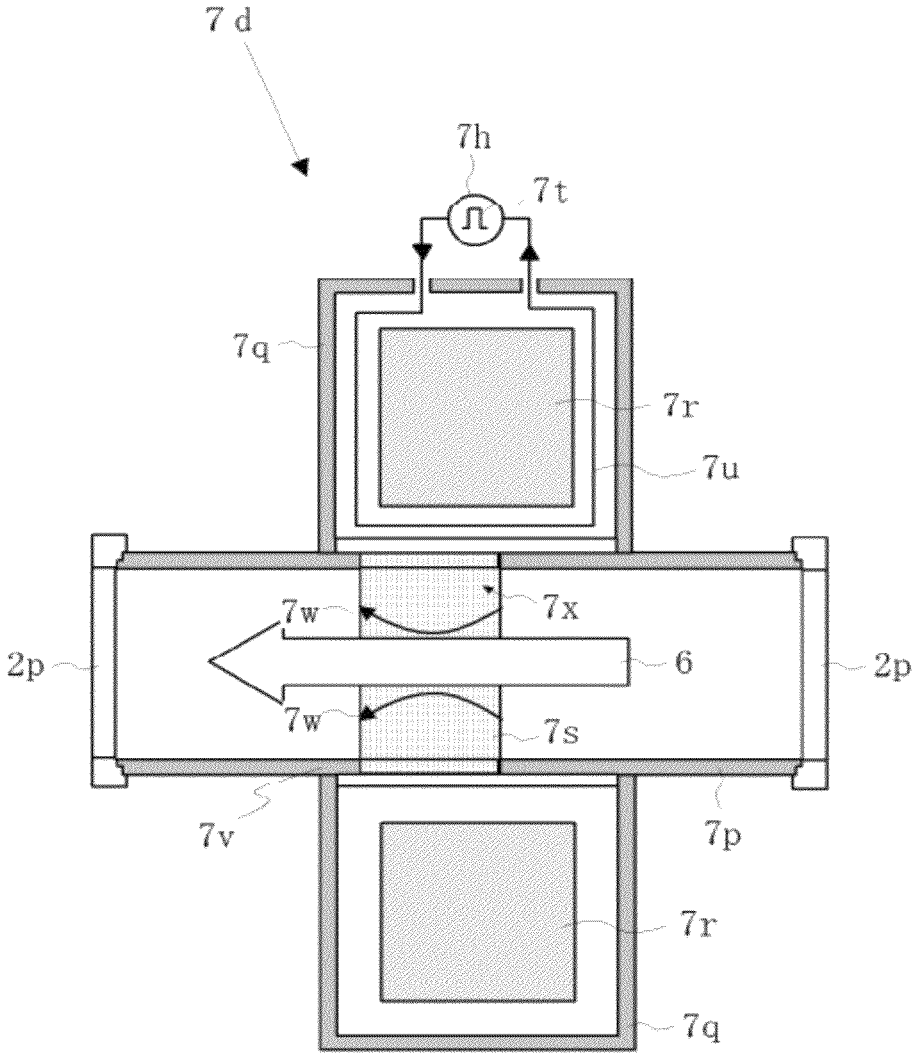
FIG. 3 is a schematic cross-sectional view of an induction accelerating cell connected to a vacuum duct.

As shown in FIG. 3, the induction accelerating cell 7*d* may be the same as the induction accelerating cell which is used to generate an induced voltage for acceleration and confinement in the methods described in Patent Literatures 2 to 6. In the induction accelerating cell 7*d*, the pulse voltage 7*a* is applied to a part of the charged particle beam 6 to generate resonance oscillations in the part of the charged particle beam 6, and a part of the charged particle beam 6 is extracted to the emission line 4 by an emission deflector, or the like, based on the third resonance. Note that the resonance order is not limited to the tertiary order, and, for example, the secondary order may also be adopted. Further, when the application of the pulse voltage is controlled without using the emission deflector, that is, when the charged particle beam is moved by the pulse voltage from its circulating orbit to a region not influenced by the magnetic field, the charged particle beam can be linearly extracted to the emission line only by using the pulse voltage.

FIG. 3 is a schematic cross-sectional view of the induction accelerating cell connected to a vacuum duct. Here, the induction accelerating cell 7*d* has principally the same configuration as that of the induction accelerating cell used in the linear induction accelerator conventionally manufactured.

The induction accelerating cell 7*d* has a double structure configured by an inner cylinder 7*p* and an outer cylinder 7*q*, and a magnetic body 7*r* is inserted in the inside of the outer cylinder 7*q* to form an inductance. A part of the inner cylinder 7*p*, connected to a vacuum duct 2*p* in which the charged particle beam 6 is circulated, is made of an insulator 7*s*, such as ceramics.

When a pulse voltage of 7*t* is applied to a primary electric circuit surrounding the magnetic body 7*r* from a switching power supply 7*h* connected to a DC charger 7*i*, primary current 7*u* flows through a primary conductor. The primary current 7*u* generates magnetic flux around the primary conductor, so that the magnetic body 7*r* surrounded by the primary conductor is excited.

Thereby, the density of magnetic flux, which penetrates the magnetic body 7*r* having a toroidal shape, is increased with time. At this time, according to the Faraday's Law, an induced electric field is generated at the secondary insulation section the both sides of which are end sections 7*v* of the conductive inner cylinders 7*p* that are respectively provided so as to sandwich the insulator 7*s* therebetween. The induced electric field becomes an electric field 7*w*. The portion, in which the electric field 7*w* is generated, is referred to as an accelerating gap 7*x*. Therefore, the induction accelerating cell 6 is a transformer having a ratio of 1:1 in this example.

When the switching power supply 7*h*, which generates the pulse voltage of 7*t*, is connected to the primary electric circuit of the induction accelerating cell 7*d*, and when the switching power supply 7*h* is turned on and off from the outside, the generation of the accelerating electric field can be freely controlled. Therefore, in the induction accelerating cell 7*d*, the pulse voltage 7*t* is received in the primary electric circuit from the switching power supply 7*h*, is induced at the secondary insulation section and generates the induced voltage 7*a*, which is applied to the charged particle beam 6.

Further, the control apparatus 7*e* of the pulse voltage generation apparatus 7 will be described with reference to FIG. 2. The control apparatus 7*e* is an apparatus which is configured by a position monitor 2*e*, a bunch monitor 2*d*, a digital signal apparatus 7*n*, a pattern generator 7*k*, the switching power supply 7*h*, the DC charger 7*i*, an electrical transmission line 7*g*, an induced voltage monitor 7*f*, and the like, and which controls the generation timing of the pulse voltage 7*a* generated by the induction accelerating cell 7*d* so that the pulse voltage 7*a* is applied to a part of the charged particle beam 6. The details of the control apparatus 7*e* is described in Patent Literature 6.

The position monitor 2*e* is a monitor provided in the vacuum duct 2*p* to detect the position of the center of gravity of the charged particle beam 6, and detects an amount by which the charged particle beam 6 is deviated from a design orbit 2*a* to the inner or outer side in the horizontal direction.

Further, the position monitor 2*e* is an apparatus which outputs a voltage value proportional to the amount of deviation of the charged particle beam 6 from the design orbit 2*a*. The position monitor 2*e* is configured by, for example, two conductors each having a slit inclined with respect to the traveling direction s of the charged particle beam 6, and electric charges are induced in the conductor surface due to the passage of the charged particle beam 6.

The amount of induced charges depends on the position of the charged particle beam 6 between the conductors, and hence the amount of charges induced in each of the two conductors is made different depending on the position of the charged particle beam 6. As a result, a difference is caused between the values of the voltages respectively induced in the two conductors, and the voltage difference is used in the position monitor 2*e*. A position signal 2*g*, which is information on the detected horizontal position of the charged particle beam, is inputted into the digital signal apparatus 7*n*, so as to be used for generation and control of the pulse voltage 7*a*. The position signal 2*g* is mainly used to control the horizontal deviation of the orbit of the charged particle beam so that the orbit is held in a state suitable for extraction of the charged particle beam.

The bunch monitor 2*d* is a monitor provided in the vacuum duct 2*p* to detect the passage of the charged particle beam 6, and generates a passage signal 2*f* as a pulse signal at the moment of passage of the charged particle beam. The passage signal 2*f*, which is information on the detected passage of the charged particle beam, is inputted into the digital signal apparatus 7*n*, so as to be used for generation and control of the pulse voltage 7*a*. The passage signal 2*f* is mainly used to control the generation of the pulse voltage 7*a* to be synchronized with the passage of the charged particle beam 6.

The switching power supply 7*h* supplies the pulse voltage 7*t* to the induction accelerating cell 7*d* via the transmission line 7*g*, and can be highly repetitively operated. Generally, the switching power supply 5*b* has a plurality of current paths and generates positive and negative voltages at the load (here the induction accelerating cell 7*d*) by adjusting the current passing through each of the current paths and controlling the direction of the current. The DC charger 7*i* supplies electric power to the switching power supply 7*h*. The on/off operations of the switching power supply.7*h* is controlled by the pattern generator 7*k* and the digital signal processing apparatus 7*n*. The induced voltage monitor 7*f* is a monitor which measures a value of the induced voltage applied by the induction accelerating cell 6.

Note that the pulse voltage 7*a* is formed by a positive pulse voltage which accelerates a part of the charged particle beam in the traveling direction s of the charged particle beam, and by a negative pulse voltage which prevents the magnetic saturation of the induction accelerating cell and which acts on a part of the charged particle beam in the direction opposite to the traveling direction of the charged particle beam. There is a case where both the positive and negative pulses are applied to the charged particle beam.

The pattern generator 7*k* generates a gate signal pattern 7*j* which controls the on/off operations of the switching power supply 7*h*. That is, the pattern generator 7*k* is an apparatus which, on the basis of a gate parent signal 7*m*, performs conversion to provide a combination of on/off of the current paths of the switching power supply 7*h*. The digital signal processing apparatus 7*n* calculates the gate parent signal 7*m* which is an original signal used for the generation of the gate signal pattern 7*j* by the pattern generator 7*k*.

The gate signal pattern 7*j* means a pattern which is used to control the pulse voltage 7*a* applied from the induction accelerating cell 7*d*. The gate signal pattern 7*j* is a signal which, when the pulse voltage 7*a* is applied, determines the application time and the generation timing of the pulse voltage 7*a*, and also is a signal which determines a pause time between the positive pulse voltage and the negative pulse voltage. Therefore, the application timing and the application time of the pulse voltage 7*a* can be adjusted by the gate signal pattern 7*j* so as to correspond to the length of the charged particle beam to be accelerated.

The beam monitor 9 is a monitor which is provided in the transport path of the extracted charged particle beam 6, and which measures and monitors the intensity of current of the charged particle beam 6 at the moment of the passage of the charged particle beam 6 through the beam monitor 9.

When the charged particle beam 6 is represented as a primary coil, and when the detector side is represented as a secondary coil, the beam monitor 9 is configured on the basis of a principle equivalent to the principle of a common current transformer. When the charged particle beam serving as current by itself passes through the magnetic body around which the secondary coil is wound, and then when a voltage or current induced in the secondary coil is measured, the instantaneous value of current of the charged particle beam is measured without destroying the charged particle beam.

The charged particle beam intensity [A] obtained by the beam monitor 9 is converted into numerical information by an analog-to-digital converter. The digital numerical information is sent, as a beam intensity signal 9*a*, to the pulse voltage generation apparatus 7, and is used for the extraction control (referred to as "feedback control 9*b*") of the charged particle beam 6 in the subsequent and following circulation of the charged particle beam 6 in the synchrotron 2.

In the following, the feedback control 9*b* will be described in detail. The beam intensity signal 9*a* is inputted into the digital signal apparatus 7*n* of the pulse voltage generation apparatus 7. The information on the current intensity of the charged particle beam to be extracted is stored at a certain moment in the digital signal apparatus 7*n*, and is compared with the beam intensity signal 9*b*.

Note that the method for providing the information on the intensity of current of the charged particle beam to be extracted is not limited to the method of providing the information as data beforehand, and the information may also be provided, for example, by a real-time arithmetic operation using a function, and the like. When the value of the beam intensity signal 9*b* is larger than the stored beam intensity, the beam intensity is excessive, and hence the pulse voltage 7*a* is controlled so as to reduce the intensity of the beam to be extracted.

Specifically, in the traveling direction of the charged particle beam, a negative pulse voltage is applied to the part where a positive pulse is applied, or the time width of the positive pulse voltage is reduced. In this case, when Δp/p is reduced, since the stable region of the charged particles is increased, the intensity of the charged particle beam to be extracted can be reduced, or the extraction of the charged particle beam can be stopped.

On the other hand, when the value of the beam intensity signal 9*b* is smaller than the stored beam intensity, the beam intensity is insufficient, and hence the pulse voltage is controlled to increase the intensity of the beam to be extracted. Specifically, the beam current which contributes to the extraction is increased in such a manner that, in a part in the traveling direction of the charged particle beam, to which part the positive pulse voltage is applied, the pulse voltage application rate per circulation is increased, or the time width of the positive pulse voltage is increased.

Figure 4:
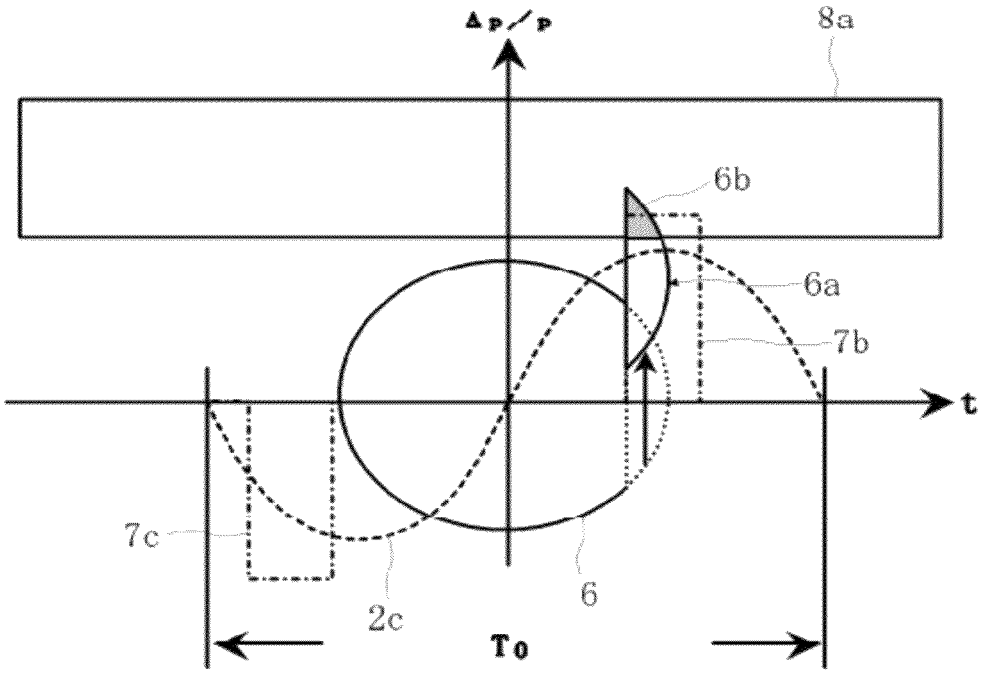
FIG. 4 is a schematic view which shows the principle of a charged particle beam extraction method according to the present invention and in which the momentum deviation of the charged particle beam in its traveling direction is represented by using time (t) as a reference.
Figure 8:
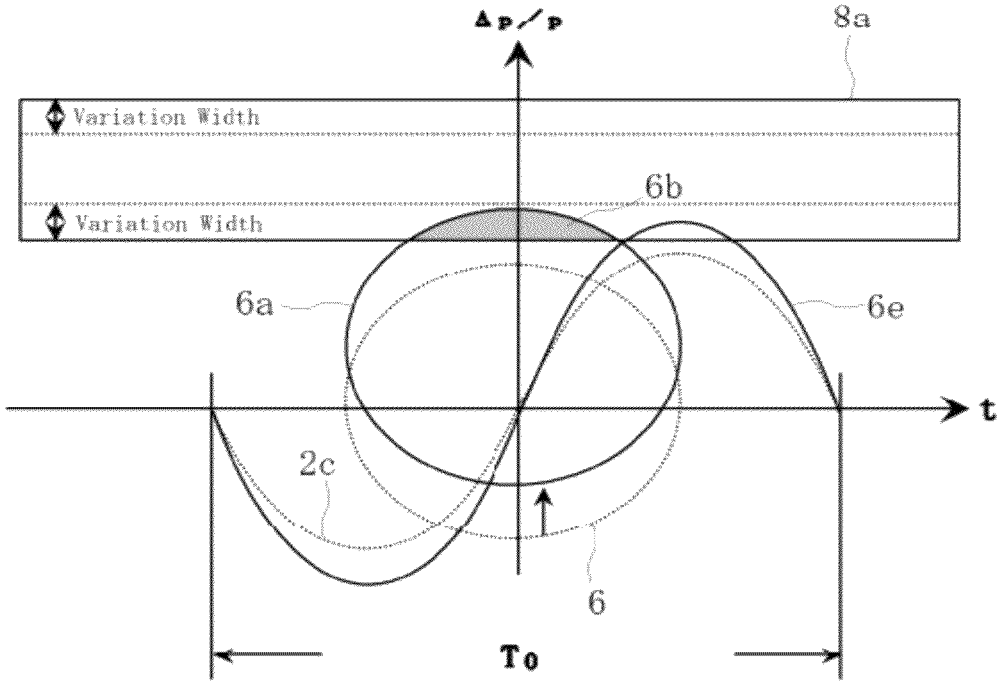
FIG. 8 is a schematic view which shows the principle of a conventional charged particle beam extraction method and in which the momentum deviation of the charged particle beam in its traveling direction is represented by using time (t) as a reference.
Figure 9:
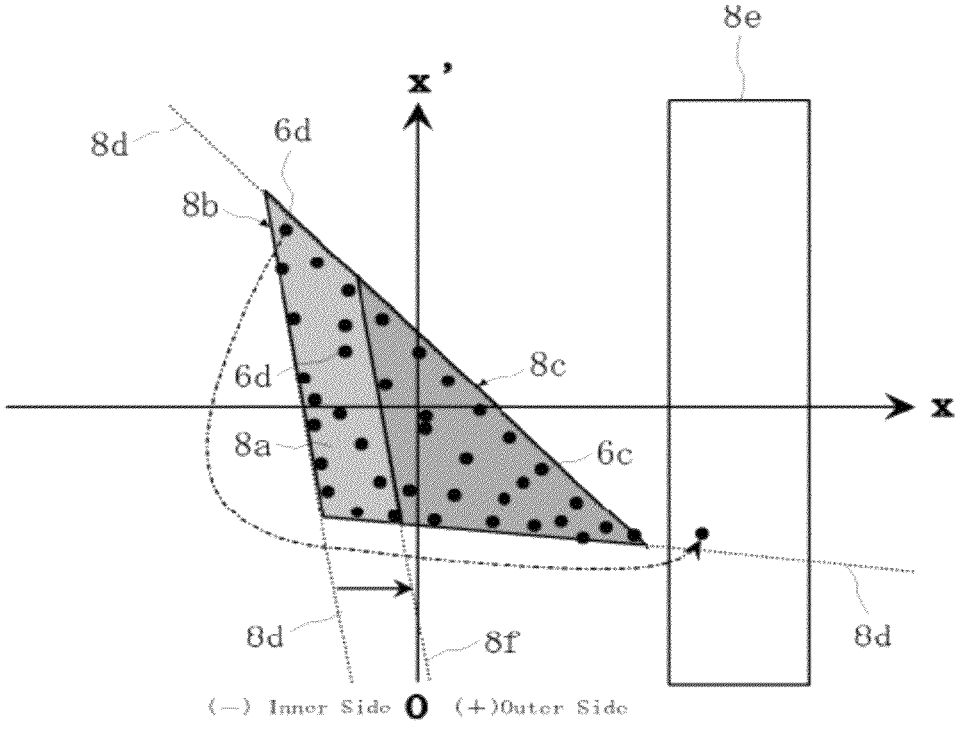
FIG. 9 shows distribution of the charged particles in a phase space in a conventional circular accelerator.

FIG. 4 is a schematic view of an example of the pulse voltage generation apparatus. FIG. 4 is a schematic view which shows the principle of the charged particle beam extraction method according to the present invention, and in which the momentum deviation (Δp/p) in the traveling direction of the charged particle beam 6 is represented as the distribution with respect to time (t) using the circulation time of a reference particle as a reference. The meaning of reference numerals and characters are the same as those in FIG. 8.

As shown in FIG. 4, when a pulse voltage (positive pulse voltage 7*b*) shown by the broken-dotted line is applied to a part of the charged particle beam 6 accelerated by a high-frequency voltage 2*c* that is shown by the wavy line (broken chain line) and applied in the high-frequency accelerating cavity 2*b*, a charged particle group 6*a* of a part (dotted line portion) of the charged particle beam 6 is accelerated (as shown by the upward arrow).

Then, the momentum deviation (Δp/p) is increased, and a part (charged particle group 6*b*) of the accelerated charged particle group 6*a* is located in a non-stable region 8*a*, so as to be extracted eventually into the emission line 4. Note that a negative pulse voltage 7*c* not only is used to prevent the magnetic saturation, but also can be used to decelerate the charged particle beam 6 by being applied to the charged particle beam 6 as required.

In the present invention in which the momentum deviation (Δp/p) of a part (charged particle group 6*a*) of the charged particle beam 6 is increased by the application of the pulse voltage 7*a*, the charged particle beam 6, to which the pulse voltage 7*a* is not applied, is located away from the non-stable region, and the unnecessary extraction phenomenon of the charged particle beam 6 due to noise is not generated. Therefore, the beam intensity of the extracted charged particle beam 6 can be intentionally adjusted by using the pulse voltage 7*a*.

Further, also when the extraction of the charged particle beam is stopped, the state of the entire charged particle beam need not be restored to the state before the extraction by using the low high-frequency voltage 6*e*, and the extraction can be stopped by locally applying the pulse voltage 7*a*. Therefore, the next extraction of the charged particle beam 6 can be performed at high speed as compared with the prior art.

Figure 5:
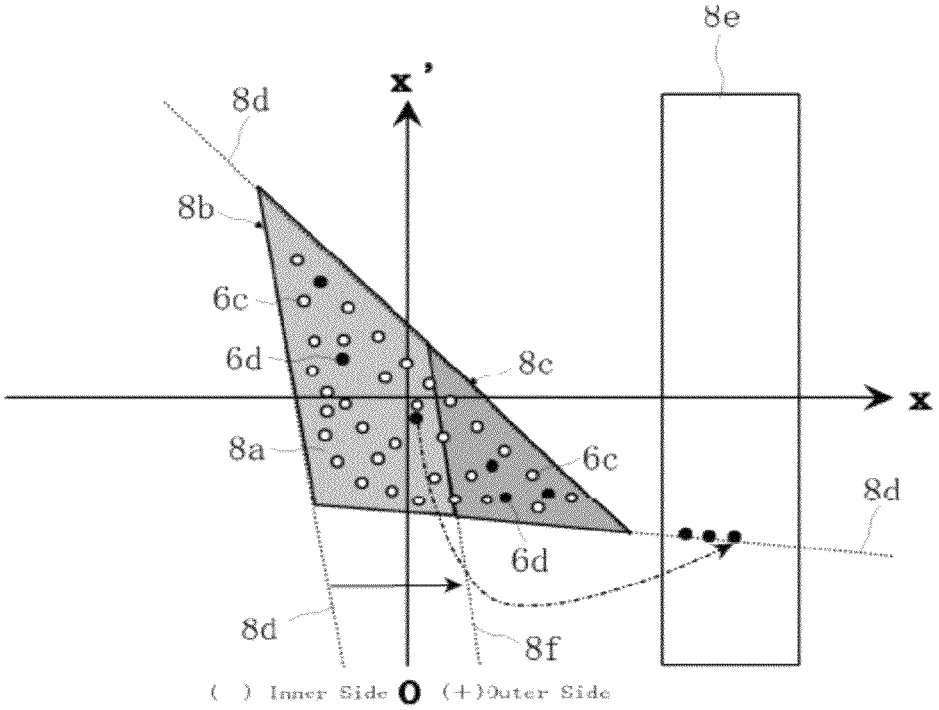
FIG. 5 shows distribution of the charged particles in a phase space when a pulse voltage is applied to the charged particle beam.

FIG. 5 shows distribution of the charged particles in the phase space when the pulse voltage is applied to the charged particle beam. The meanings of reference characters are the same as those in FIG. 8.

As shown in FIG. 5, the stability condition in the horizontal direction x is determined by the position of the charged particle beam 6 in the horizontal direction x, and by the horizontal gradient (x'=dx/ds) of each of the charged particles. A stable region 8*b* (Δp/p=0.002) of the charged particle beam 6 before the application of the pulse voltage 7*a* corresponds to a (large) triangle surrounded by boundaries 8*d*.

When the pulse voltage 7*a* is applied to a part of the charged particle beam 6 in order to extract the charged particle beam 6, a group of charged particles 6*d* (black dots) of a part of the charged particle beam 6 are accelerated, and a stable region 8*c* (Δp/p=0.003) of the charged particles 6*d* is reduced to be a narrowed (small) triangle shown by an oblique line 8*f*. On the other hand, the group of charged particles 6*c* (white circles), to which the pulse voltage 7*a* is not applied, still remain in the (large) triangle of the stable region 8*b*.

That is, the portion obtained by excluding the stable region 8*c* from the stable region 8*b* becomes the non-stable region 8*a* of the charged particles of the part of the charged particle beam 6, to which part the pulse voltage 7*a* is applied. Therefore, only the charged particles 6*d* (black dots) located in the non-stable region 8*a* are located in an extraction region 8*e*, so as to be extracted into the emission line 4.

Further, in the present invention, since only a part of the charged particles are accelerated, the group of the charged particles to which the pulse voltage 7*a* is not applied are located sufficiently within the stable region (resonance condition), and hence the charged particle beam having an extremely constant beam intensity can be extracted without being affected by noise.

In addition, the intensity of the extracted beam can be adjusted by changing the voltage value and the pulse length of the induced voltage 7*a*. Further, the beam intensity can be highly precisely controlled by performing the feedback control 9*b* in which the generation frequency, the missing, the voltage value, and the pulse length of the pulse voltage are changed on the basis of the detection value of the beam monitor 9,

EXAMPLE 1

Figure 6:
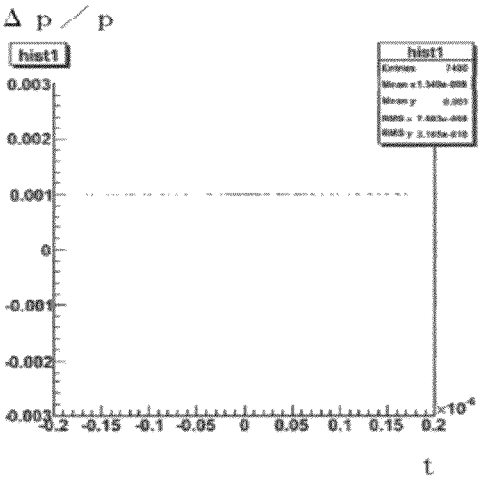
FIG. 6 shows a comparison between a simulation result in the case (A) where the charged particle beam is not extracted and a simulation result in the case (B) where the charged particle beam is extracted by the method according to the present invention.
Figure 6:
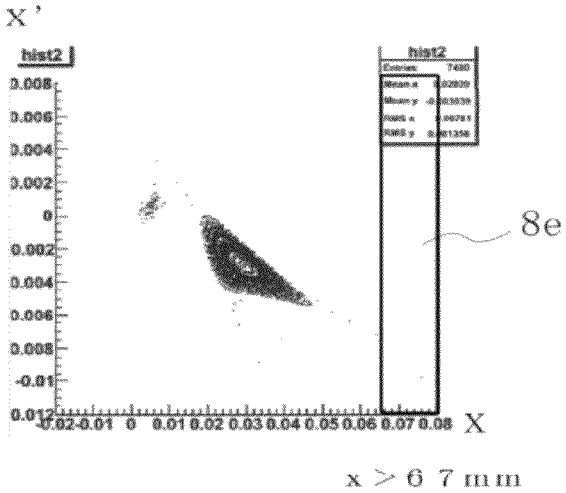
Figure 6:
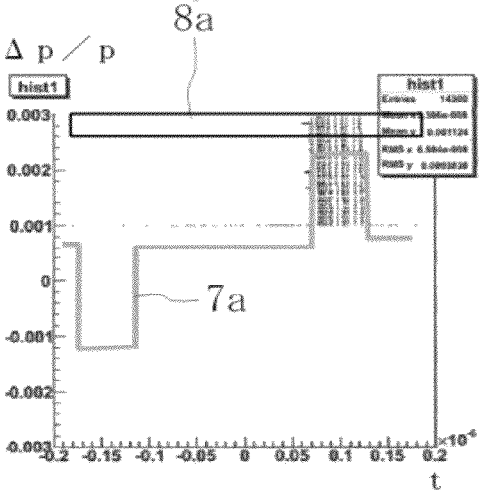
Figure 6:
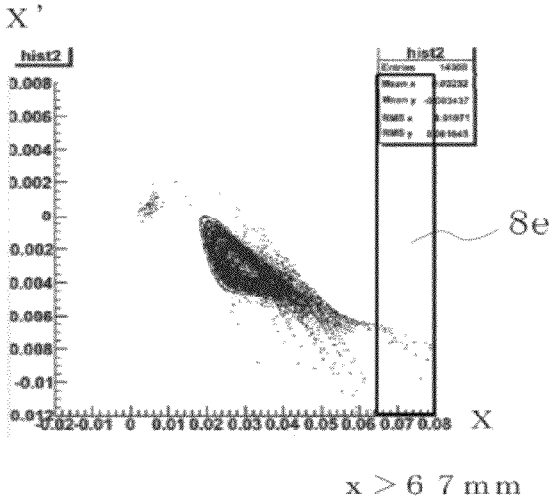

FIG. 6 shows a comparison between a simulation result in the case (A) where the charged particle beam is not extracted and a simulation result in the case (B) where the charged particle beam is extracted by the method according to the present invention.

In the simulation, a synchrotron used for a particle beam therapy apparatus actually designed and manufactured was used as a model. Further, the length of synchrotron circulating path, the deflection magnetic field intensity, the convergence magnetic field intensity, the six pole magnetic field intensity, and the extraction position of the emission deflector were inputted and set to the parameters used in a synchrotron actually manufactured and usually operated.

The simulation was performed on the assumption that the number of charged particles is 1000, and that the number of circulation of the particles is 1000 (corresponding to 0.3 ms in real time). Note that, in verification of fundamental beam physics, the result of the simulation by the present simulation method was verified by being compared with the result of the simulation based on the existing beam physics code that has been actually used, and also with the result of the design study of the manufactured synchrotron. As a result, it was confirmed that the behavior of the charged particles in the phase space at the time of extraction of the charged particle beam is equivalently reproduced in both the simulation results.

In each of FIGS. 6(A) and 6(B), the left figure shows phase space distribution of the charged particles in the traveling direction s, and the right figure shows phase space distribution of the charged particles in the horizontal direction x. In FIG. 6(B), the positive pulse voltage 7*b* was applied to 20% of the charged particles.

The distribution was obtained by plotting all the phase space positions of the charged particles at the number of circulations of 1000 times. The right figure shows that each of the charged particles circulates along a closed orbit so as to revolve in the triangular stable region in the counterclockwise direction.

As a result, it could be confirmed that, in the case (A) where the charged particle beam is not extracted, almost no charged particle exists in the extraction region 8*e*, and that, in the case (B) where the pulse voltage 7*a* is applied to a part (20%) of the charged particle beam by the method of the present invention (left figure in FIG. 6(B)), many dots (charged particles) exist in the extraction region 8*e* (right figure in FIG. 6(B)).

Between the case (A) where the charged particle beam is not extracted, and the case (B) where the charged particle beam is extracted by the method of the present invention, there is no difference in the physical parameters except that the pulse voltage is locally applied in the case (B). That is, it is seen that only the pulse voltage is a factor contributing to the extraction of the charged particle beam. Further, it is seen that, when the charged particle beam is held in the stable region, unintended extraction of the charged particle beam is not performed.

In the left figure of FIG. 6(B), the behavior of the accelerated charged particles (having a large momentum deviation $\Delta p/p$) is changed in the phase space in the horizontal direction (x) in the right figure, so as to enter into the non-stable region 8*a* from the stable field 8*c*. This appears as an increase in the number of the charged particles in the extraction region 8*e* ($x>67$ mm) in the horizontal direction x.

Therefore, it is seen that, when the pulse voltage 7*a* is applied to the charged particles which are a part of the charged particle beam and have different momentum deviations $\Delta p/p$, only the charged particles, each of which draws a different orbit for each value of $\Delta p/p$ in the horizontal direction (x), and to which the pulse voltage 7*a* is applied, are extracted.

EXAMPLE 2

Figure 7:
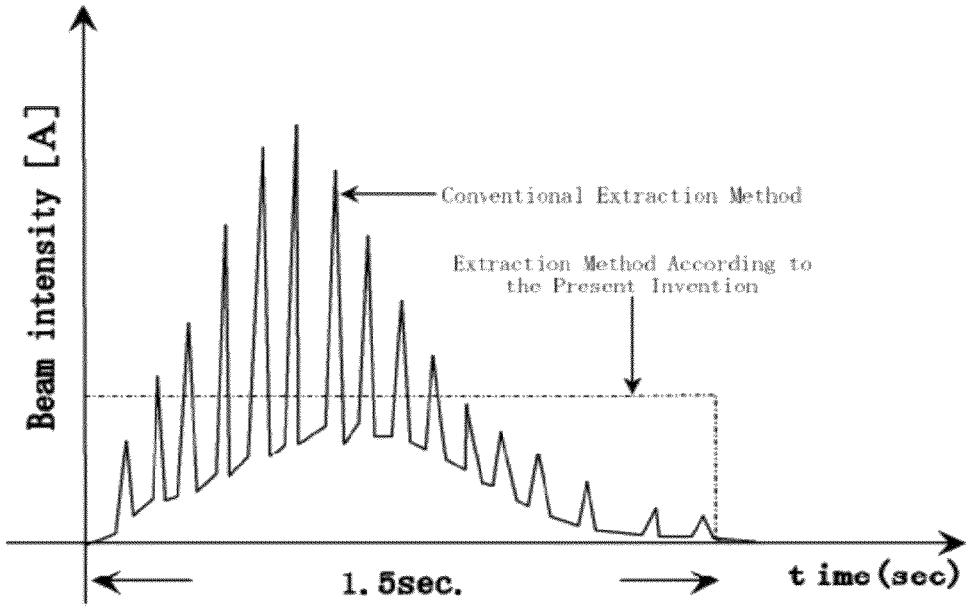
FIG. 7 shows a comparison result (obtained by simulation) between the intensity (broken line) of the charged particle beam extracted by the charged particle beam extraction method according to the present invention and the intensity (solid line) of the charged particle beam extracted by the conventional charged particle beam extraction method.

FIG. 7 shows a comparison between a simulation result of the charged particle beam intensity (broken line) obtained by the charged particle beam extraction method according to the present invention and a simulation result of the charged particle beam intensity (solid line) obtained by the conventional charged particle beam extraction method. The simulation was performed on the assumption that, after 1000 charged particles are made to circulate 1000 times, the charged particle beam is extracted respectively by the extraction method (conventional extraction method) described in Patent Literature 1, and by the extraction method according to the present invention in which the pulse voltage 7*a* is applied to the charged particle 6. By the simulation, a measured value of the charged particle beam intensity, which can be assumed to be measured by the beam monitor 9, was obtained for each of the extraction methods. In FIG. 7, in which the ordinate represents the beam strength [A], and in which the abscissa represents the time (second), the time period of 1.5 seconds is the time period required to extract the charged particle beam in the synchrotron.

As shown in FIG. 7, in the conventional charged particle beam extraction method, the temporal variation of the beam intensity of the extracted charged particle beam is inevitably increased.

As described above, in the conventional charged particle beam extraction method, the horizontal outer edge of the charged particle beam is always in contact with the resonance line (boundary line), and hence the variation of the beam intensity due to noise acts as a trigger to cause the phenomenon in which the extraction of the charged particle beam is started and stopped.

As described above, in the conventional charged particle beam extraction method, when the charged particle beam is extracted by accelerating the entire charged particle beam, the reduction rate of the stable region of the charged particle beam in the lateral direction is not fixed in time, and also the uncontrollable extraction of the charged particle beam is caused due to noise as described above. As a result, the beam intensity of the extracted charged particle beam cannot be made constant.

Further, even when the charged particle beam is extracted by resonating the charged particle beam in the lateral direction, the lateral charged particle beam distribution is deviated. Thus, it is necessary to control the resonance amplitude of the charged particle beam in order to temporally stabilize the beam intensity, and also it is impossible to intentionally adjust the distribution of the extracted charged particle beam.

On the other hand, in the present invention, it is clarified by the above-described simulation that the beam intensity of the extracted charged particle beam is made constant and that a corresponding part of the charged particle beam can be extracted for every 1000 circulations (every 0.3 ms). The application of the pulse voltage to a part of the charged particle beam can be performed in a time period sufficiently shorter than 1 ms, and hence the control of extraction of the charged particle beam can be performed so that the beam intensity is intentionally fixed at high speed and with high accuracy even in a time period of 1 ms or less.

In the extraction method according to the present invention, the pulse voltage is applied so that an acceleration voltage (a deceleration voltage in some cases) is applied to a part (a group of charged particles to be extracted) in the charged particle beam, and hence the condition (resonance condition) that the energy error of the charged particles in the charged particle beam is a certain value or more is satisfied only by the group of charged particles to be extracted.

That is, in the present invention, the extraction of the charged particle beam due to noise is prevented in such a manner that the momentum deviation ($\Delta p/p$) of the entire charged particle beam in its traveling direction is reduced and thereby the stable region of the charged particle beam is kept to a size which prevents the charged particle beam from being extracted due to noise. Also, the beam intensity adjustment using the charged particle distribution in its traveling direction can be performed by locally applying the pulse voltage to the charged particle beam and adjusting the time width of the pulse voltage. The method, in which the charged particle distribution is changed in the traveling direction of the charged particles, can be easily performed by changing the amplitude and shape of the voltage applied to confine the charged particle beam in its traveling direction, and there are many examples of the method.

INDUSTRIAL APPLICABILITY

In the charged particle beam extraction method according to the present invention, the irradiation dose of the charged particle beam can be highly precisely controlled in such a manner that the charged particle beam is stably extracted at high speed by using the pulse voltage and thereby further the intensity of the extracted charged particle beam is made uniform. Therefore, with the charged particle beam extraction method according to the present invention, which is expected to be applied, in particular, to a medical field, it is possible to reduce the irradiation time and to highly precisely perform the irradiation treatment, and hence the burden on a patient can be reduced.

REFERENCE SIGNS LIST

1 Accelerator
1*a* Accelerator
2 Synchrotron
2*a* Design orbit
2*b* High frequency accelerating cavity
2*c* High-frequency voltage
2*d* Bunch monitor
2*e* Position monitor
2*f* Passage signal
2*g* Position signal
2*h* High-frequency voltage
2*i* Deflecting electromagnet
2*j* Converging electromagnet
2*k* Divergent electromagnet
2*m* High-frequency voltage application apparatus
2*n* Synchrotron
2*p* Vacuum duct
3 Injection Line
3*a* Preceding stage acceleration
3*b* Injector
3*c* Transport pipe
4 Emission Line
4*a* Emitter
4*b* Transport pipe
5 Beam utility line
6 Charged particle beam
6*a* Charged particle group
6*b* Charged particle group
6*c* Charged particle
6*d* Charged particle
6*e* High-frequency voltage
7 Pulse voltage generation apparatus
7*a* Pulse voltage
7*b* Positive pulse voltage
7*c* Negative pulse voltage
7*d* Induction accelerating cell
7*e* Control apparatus
7*f* Induced voltage monitor
7*g* Electrical transmission line
7*h* Switching power supply
7*i* DC charger
7*j* Gate signal pattern
7*k* Pattern generator
7*m* Gate parent signal
7*n* Digital signal processing apparatus
7*p* Inner cylinder
7*q* Outer cylinder
7*r* Magnetic body
7*s* Insulator
7*t* Pulse voltage
7*u* Primary current
7*v* End section
7*w* Electric field
7*x* Accelerating gap
8 Six pole magnet
8*a* Non-stable region
8*b* Stable region
8*c* Stable region
8*d* Boundary
8*e* Extraction region
8*f* Boundary
9 Beam monitor
9*a* Beam intensity signal
9*b* Feedback control
10 Beam extraction control mechanism

The invention claimed is:

1. A charged particle beam extraction method of a circular accelerator accelerating a charged particle beam, wherein a momentum deviation is generated only in a part of the accelerated charged particle beam by applying a pulse voltage to a part of the charged particle beam, and thereby a part of the charged particles, the part having a large momentum deviation, is located in a non-stable region and in an extraction region in a horizontal phase space with respect to the traveling direction of the charged particle beam, and wherein a group of the charged particles located in the non-stable region and in the extraction region is extracted by selectively and largely deviating the group in the horizontal direction.

2. The charged particle beam extraction method according to claim 1, further comprising feedback control in which a beam monitor is provided in an extraction line of the charged particle beam, and the number of times of application of the pulse voltage to the charged particle beam is determined on the basis of a beam intensity signal from the beam monitor.

3. The charged particle beam extraction method according to claim 1 or 2, wherein the pulse voltage is a positive voltage or a negative voltage in the traveling direction of the charged particle beam.

4. The charged particle beam extraction method according to claim 1, wherein the beam intensity of the charged particle beam to be extracted is adjusted by adjusting the voltage value of the pulse voltage or the application time period of the pulse voltage.

5. An accelerator including an injection apparatus of charged particles, a synchrotron which accelerates the charged particles by a high-frequency accelerating cavity, an emission apparatus of the charged particles, and a charged particle beam utility line, the accelerator further comprising, on a design orbit of a circulating charged particle beam, a pulse voltage generation apparatus which applies a pulse voltage to a part of the charged particle beam, wherein a momentum deviation is generated only in a part of the accelerated charged particle beam by applying the pulse voltage to a part of the charged particle beam, and thereby the charged particles of a part of the charged particle beam, the charged particles having a large momentum deviation, are located in a non-stable region and in an extraction region in a horizontal phase space with respect to the traveling direction of the charged particle beam, and wherein a group of the charged particles located in the non-stable region and in the extraction region are extracted into the charged particle beam utility line by using the emission apparatus which selectively and largely deviates the group of the charged particles in the horizontal direction.

6. The accelerator according to claim 5, further comprising feedback control means which includes a beam monitor provided in an extraction line for extracting the charged particle beam to the charged particle utility line, and determines the number of times of application of the pulse voltage to the charged particle beam on the basis of a beam intensity signal of the beam monitor.

7. The accelerator according to claim 5 or 6, wherein the pulse voltage generation apparatus applies, from an induction accelerating cell, the pulse voltage to a part of the charged particle beam on the basis of a passage signal from a bunch monitor which is provided on the design orbit to detect the passage of the charged particle beam, and on the basis of a position signal from a position monitor which is provided on the design orbit to detect the center-of-gravity position of the charged particle beam.

8. The charged particle beam extraction method according to claim 2, wherein the beam intensity of the charged particle beam to be extracted is adjusted by adjusting the voltage value of the pulse voltage or the application time period of the pulse voltage.

9. The charged particle beam extraction method according to claim 3, wherein the beam intensity of the charged particle beam to be extracted is adjusted by adjusting the voltage value of the pulse voltage or the application time period of the pulse voltage.

* * * * *